US005405156A

United States Patent [19]

Gonella

[11] Patent Number: 5,405,156

[45] Date of Patent: Apr. 11, 1995

[54] SKATE WITH ALIGNED WHEELS

[75] Inventor: Mario Gonella, Conegliano, Italy

[73] Assignee: Nordica S.p.A., Montebelluna, Italy

[21] Appl. No.: 119,182

[22] PCT Filed: Jan. 20, 1993

[86] PCT No.: PCT/EP93/00125

§ 371 Date: Sep. 23, 1993

§ 102(e) Date: Sep. 23, 1993

[87] PCT Pub. No.: WO93/14840

PCT Pub. Date: Aug. 5, 1993

[30] Foreign Application Priority Data

Jan. 31, 1992 [IT] Italy ..... TV92A0013

[51] Int. Cl.[6] ..... A63C 17/06

[52] U.S. Cl. ..... 280/11.28; 280/11.22

[58] Field of Search ..... 280/11.28, 11.22, 11.23, 280/11.27, 11.2, 87.03, 87.041, 87.042, 7.13; 267/140.2, 141, 255, 257, 202

[56] References Cited

U.S. PATENT DOCUMENTS

| | | | |
|---|---|---|---|
| 2,025,858 | 12/1935 | Harris | 280/11.28 |
| 2,552,987 | 5/1951 | Loertz, Jr. | 280/11.28 |
| 2,558,696 | 6/1951 | Van Horn | 280/11.28 |
| 2,644,692 | 7/1953 | Kahlert | 280/11.28 |
| 2,719,725 | 10/1955 | Ware | 280/11.28 |
| 3,951,422 | 4/1976 | Hornsby | 280/11.28 |
| 4,272,090 | 6/1981 | Wheat | 280/11.28 X |
| 4,351,538 | 9/1982 | Berta | 280/11.28 X |
| 4,402,521 | 9/1983 | Mongeon | 280/11.28 X |
| 4,645,223 | 2/1987 | Grossman | 280/11.28 |
| 5,085,445 | 2/1992 | Boyden | 280/11.28 X |
| 5,135,244 | 8/1992 | Allison | 280/11.28 |

*Primary Examiner*—Margaret A. Focarino
*Assistant Examiner*—Carla Mattix

[57] ABSTRACT

A skate with aligned wheels, comprising a support for an item of footgear from which a frame protrudes downward. The ends of respective wheel supporting trucks are pivoted to the frame. The peculiarity of the invention resides in the fact that two movable sliders are interposed between the trucks and the respective supports. Advantageously, at least one rubber pad is interposed between each truck and support. The skate allows the user to preset the degree of shock-absorption during skating by varying the position of the slider.

6 Claims, 2 Drawing Sheets

SKATE WITH ALIGNED WHEELS

BACKGROUND OF THE INVENTION

The present invention relates to a skate with aligned wheels.

A first conventional type of skate with aligned wheels has a support for an item of footgear from which a pair of longitudinal shoulders protrudes. A plurality of aligned wheels is freely pivoted transversely between the longitudinal shoulders.

This first known type of skate has some problems: the fact that the aligned wheels are pivoted in a fixed manner to the pair of shoulders entails direct transmission to the item of footgear of all the stresses due to the bumps which occur on the ground and encountered during sports practice, with consequent discomfort for the user.

The structural rigidity of this known solution also entails the transmission of vibrations to the item of footgear, and thus to the legs of the user, which penalize his sports performance.

A sports implement predominantly used by skiers for summer practice on roads is also known; it is constituted by a support for an item of footgear from which a frame protrudes downward and centrally. The ends of two pairs of wheel supporting trucks are independently pivoted to the frame, and the head of a screw with a threaded stem is connected to the support in the interspace between two adjacent wheels. A complementarily threaded nut is associated with the stem and abuts on the ground-facing surface of a connecting element which is arranged transversely to each pair of trucks. A cylindrical helical compression spring is arranged coaxially to the stem.

This known type, illustrated in the Italian patent application No. 21821 B/85, allows, by adjusting the spring compression, to vary the angle formed between each pair of wheel supporting trucks and the ground.

In this type, the adjustment of the degree of compression of the spring allows only to vary the condition of use of the implement while practicing slalom: in fact, when the spring is at its minimum setting, i.e. when the spring is not compressed, it is possible to achieve easy use for the practice of slalom, but while pushing forward and while covering straight stretches the implement yields causing a considerable deterioration of the athletic performance.

When the spring is gradually compressed, the outermost wheels of the truck pairs rise and thus separate from the ground by a more or less significant distance. This condition can improve the use of the implement while practicing slalom, but this again entails a non-optimum and thus unstable condition during straight stretches and therefore in the practice of speed skating, and in any case all the vibrations due to impacts against bumps which protrude from the ground or due to uneven parts thereof are transmitted to the item of footgear and thus to the legs of the user.

SUMMARY OF THE INVENTION

The aim of the present invention is to eliminate the above described problems in known types by providing a skate which allows to attenuate the stresses transmitted to the legs of the user in relation to travel over uneven or rough ground, keeping constant the arrangement of the wheels with respect to the ground.

Within the scope of the above aim, an important object is to provide a skate which allows the user to preset the degree of attenuation of said stresses.

Another object is to provide a skate which can be easily activated by the user.

Another object is to provide a skate wherein the user can immediately be aware of the degree of attenuation which has been set.

A further object is to provide a skate which is simple, easy to industrialize, reliable and safe in use and has low manufacturing costs.

This aim, these objects and others which will become apparent hereinafter are achieved by a skate with aligned wheels, comprising a support for an item of footgear from which a frame protrudes downward, the end of at least one wheel supporting truck being pivoted to said frame, characterized in that at least one movable slider is interposed between said at least one truck and said support.

Preferably, a further resilient member is provided between said at least one slider and said at least one truck.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
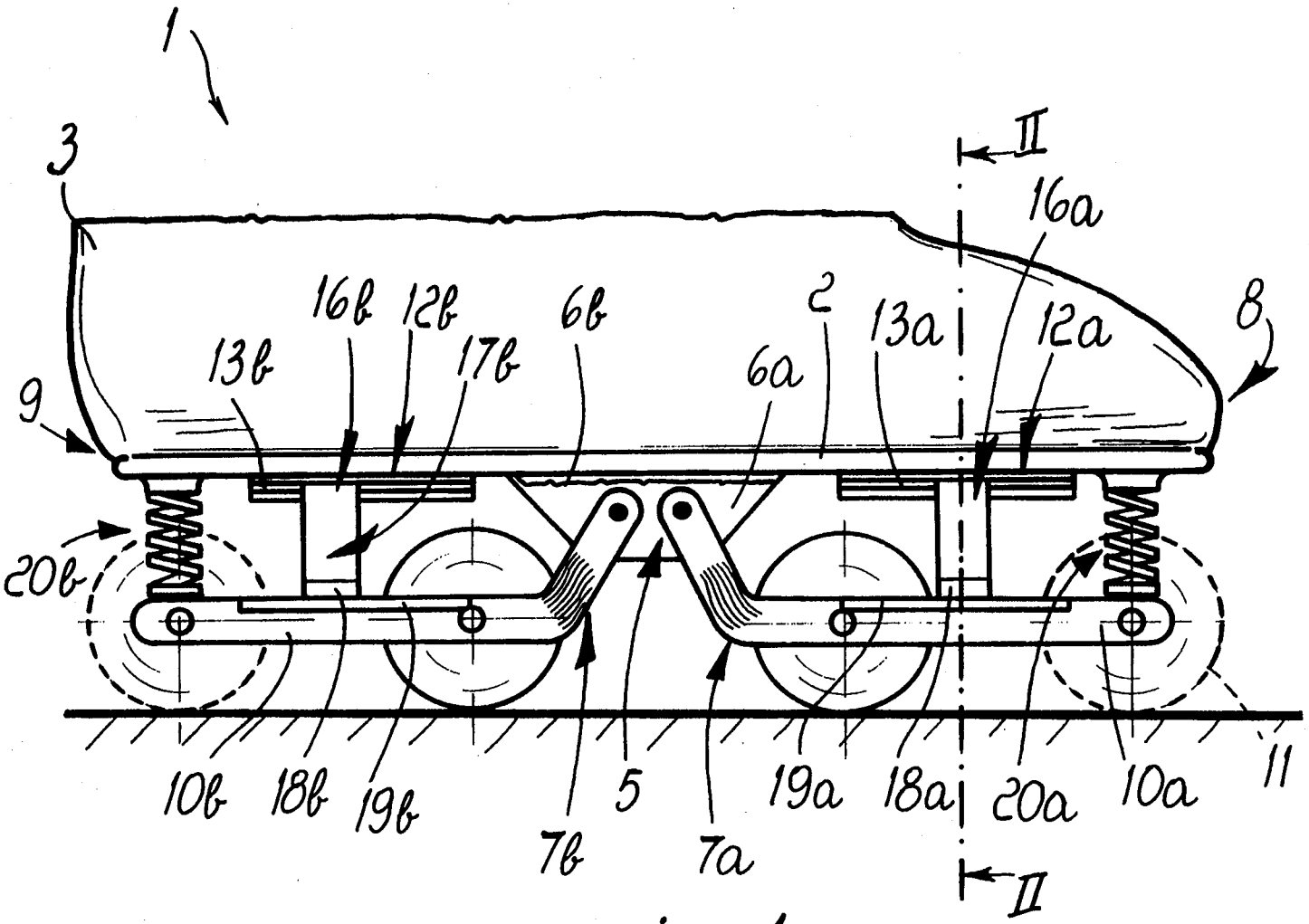
FIG. 1 is a partially sectional side view of the skate.
Figure 2:
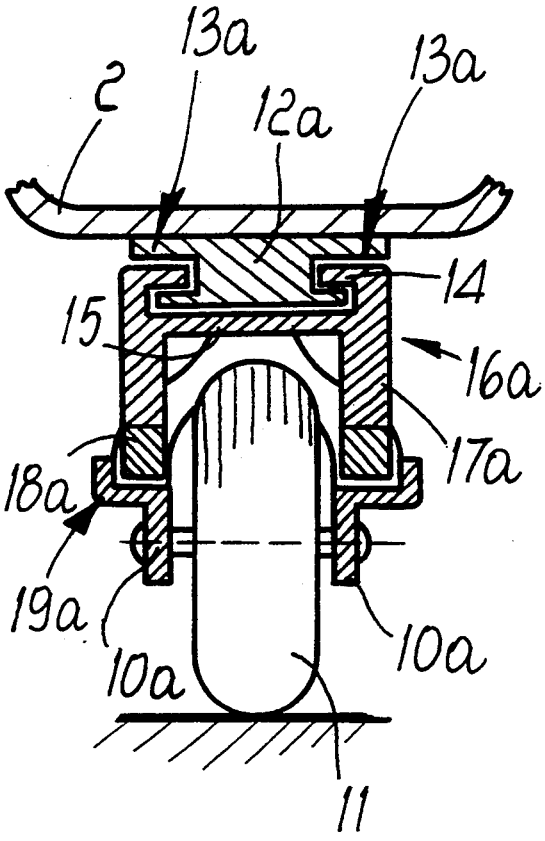
FIG. 2 is a sectional view, taken along the plane II—II of FIG. 1.

With reference to the above figures, the skate, generally designated by the reference numeral 1, comprises a support 2 for an item of footgear 3 from which a frame 5 protrudes downward. The frame is composed of two mutually parallel shoulders 6*a* and 6*b*.

The end of at least one wheel supporting truck, shaped like a fork in plan view, is pivoted to the frame.

In the embodiment of FIG. 1, the terminal ends of two trucks 7*a* and 7*b* are independently pivoted. The two trucks are arranged mutually opposite, with their free ends directed toward the tip 8 and the heel 9 of the item of footgear 3.

Each of said two trucks has a substantially L-shaped lateral profile with the longer arm 10*a*, 10*b* arranged approximately parallel to the ground. A plurality of wheels 11 are pivoted between the arms of the trucks, and are thus arranged in a line.

In the illustrated embodiment, two wheels pivoted at the longer arm of each truck have been considered by way of example.

A first plate and a second plate, designated by the reference numerals 12*a* and 12*b*, protrude below and longitudinally with respect to the support 2, approximately at the respective longer arm 10*a* and 10*b*.

Each one of said plates is laterally provided with a pair of longitudinal seats 13*a* and 13*b*, each of which guides a pair of complementarily shaped tabs 14 formed at the base 15 of a slider, designated by the reference numerals 16*a* and 16*b*, which is substantially C-shaped.

Each one of said sliders 16*a* and 16*b* therefore has a pair of wings, designated by the reference numerals 17*a* and 17*b*, with the free ground-facing ends of which a first resilient member, such as a rubber pad, designated by the reference numerals 18*a* and 18*b*, is preferably associated.

The pads face and interact with abutment flaps, designated by the reference numerals 19*a* and 19*b*, which protrude laterally and externally to each one of the trucks 7*a* and 7*b* at a region underlying said first and second plates 12*a* and 12*b*. The abutment flaps have a substantially L-shaped transverse cross-section.

At least one second resilient member, preferably constituted by two pairs of springs, designated by the reference numerals 20*a* and 20*b*, is advantageously interposed between the free end of the trucks 7*a* and 7*b* and the support 2.

The use of the skate is as follows: prior to the beginning of sports activity, the user arranges the sliders 17*a* and 17*b* in the required position with respect to the first plate 12*a* and the second plate 12*b*. In this manner he can adjust the degree of maximum oscillation to which the two trucks can be subjected. The pairs of springs 20*a* and 20*b*, arranged at the free end of-the trucks, ensure that the trucks 7*a* and 7*b* stay close to the support 2 and that they are shock-absorbed.

The pads 18*a* and 18*b* allow to further contain any sudden stresses due to the presence of bumps on the ground.

The length of the wings 17*a* and 17*b* may be the most appropriate according to the specific requirements of the user.

It has thus been observed that the invention has achieved the above described aim and objects, a skate with aligned wheels having been obtained wherein it is possible for the user to rapidly and easily adjust the degree of shock-absorption of at least one truck to which the aligned wheels are pivoted, without varying their arrangement in any way.

The use of the sliders also allows the user to be immediately aware of the set degree of attenuation.

The skate thus conceived is susceptible to numerous modifications and variations, all of which are within the scope of the inventive concept.

The materials and the dimensions of the individual elements which constitute the skate structure may naturally be the most appropriate according to the specific requirements.

I claim:

1. A skate with a front tip and a rear heel, the skate comprising:

a support having an extension which extends substantially from said front tip to said rear heel;

a truck and means for pivotally connecting said truck at a pivot point below said support about an axis which is substantially perpendicular to the extension of the support, said truck having an extending portion which has an extension which extends from said pivot point substantially towards said front tip;

at least one wheel and means for pivotally connecting said at least one wheel to said extending portion of the truck;

a slider element and means for slidably connecting said slider element to said support thereby said slider element is slidable with respect to said support along a direction which is substantially parallel to the extension of said support, said slider element being arranged between said support and said extending portion of said truck; and a resilient member connected to said slider element and engaging with said extending portion of the truck, the resilient member engaging with said extending portion at different selected points along the extension of said extending portion as a function of a selected position of said slider element with respect to said support.-

2. The skate of claim 1, further comprising a spring biasing member interconnected between said support and an end of said extending portion of the truck at a position distal from said pivot point, thereby said slider element and said resilient member being arranged between said spring biasing member and said pivot point.

3. A skate with a front tip and a rear heel, the skate comprising:

a support having an extension which extends substantially from said front tip to said rear heel;

a truck and means for pivotally connecting said truck at a pivot point below said support about an axis which is substantially perpendicular to the extension of the support, said truck having an extending portion which has an extension which extends from said pivot point substantially towards said rear heel;

at least one wheel and means for pivotally connecting said at least one wheel to said extending portion of the truck;

a slider element and means for slidably connecting said slider element to said support thereby said slider element is slidable with respect to said support along a direction which is substantially parallel to the extension of said support, said slider element being arranged between said support and said extending portion of said truck; and a resilient member connected to said slider element and engaging with said extending portion of the truck, the resilient member engaging with said extending portion at different selected points along the extension of said extending portion as a function of a selected position of said slider element with respect to said support.

4. The skate of claim 3, further comprising a spring biasing member interconnected between said support and an end of said extending portion of the truck at a position distal from said pivot point, thereby said slider element and said resilient member being arranged between said spring biasing member and said pivot point.

5. A skate with a front tip and a rear heel, the skate comprising:

a support having an extension which extends substantially from said front tip to said rear heel;

a first truck and means for pivotally connecting said first truck at a first pivot point below said support about a first axis which is substantially perpendicular to the extension of the support, said first truck having a first extending portion which has an extension which extends from said first pivot point substantially towards said front tip;

at least one first wheel and means for pivotally connecting said at least one first wheel to said first extending portion of the first truck;

a first slider element and means for slidably connecting said first slider element to said support thereby said first slider element is slidable with respect to said support along a direction which is substantially parallel to the extension of said support, said first slider element being arranged between said support and said first extending portion of said first truck; and a first resilient member connected to said first slider element and engaging with said first extending portion of the first truck, the first resilient member engaging with said first extending portion at different selected points along the extension of said first extending portion as a function of a selected position of said first slider element with respect to said support; the skate further comprising:

a second truck and means for pivotally connecting said second truck at a pivot point below said support about a second axis which is substantially perpendicular to the extension of the support, said second truck having a second extending portion which has an extension which extends from said second pivot point substantially towards said rear heel;

at least one second wheel and means for pivotally connecting said at least one second wheel to said second extending portion of the second truck;

a second slider element and means for slidably connecting said second slider element to said support thereby said second slider element is slidable with respect to said support along a direction which is substantially parallel to the extension of said support, said second slider element being arranged between said support and said second extending portion of said second truck; and a second resilient member connected to said second slider element and engaging with said second extending portion of the second truck, the second resilient member engaging with said second extending portion at different selected points along the extension of said second extending portion as a function of a selected position of said second slider element with respect to said support.

6. The skate of claim 5, further comprising a first spring biasing member interconnected between said support and an end of said first extending portion of the first truck at a position distal from said first pivot point, thereby said first slider element and said first resilient member being arranged between said first spring biasing member and said first pivot point, the skate further comprising a second spring biasing member interconnected between said support and an end of said second extending portion of the second truck at a position distal from said second pivot point, thereby said second slider element and said second resilient member being arranged between said second spring biasing member and said second pivot point.

* * * * *